US005682936A

United States Patent [19]

Higdon, Jr.

[11] Patent Number: 5,682,936

[45] Date of Patent: Nov. 4, 1997

[54] CABINET DRAWER CONSTRUCTION AND METHOD

[76] Inventor: Joseph W. Higdon, Jr., 305 W. King St., Quincy, Fla. 32351

[21] Appl. No.: 586,544

[22] Filed: Jan. 16, 1996

[51] Int. Cl.[6] ..... B27F 7/00

[52] U.S. Cl. ..... 144/345; 312/348.1; 144/347

[58] Field of Search ..... 144/345, 346, 144/347; 312/259, 261, 348.1

[56] References Cited

U.S. PATENT DOCUMENTS

| | | | |
|---|---|---|---|
| 2,487,507 | 11/1949 | Zalkind | 312/261 |
| 3,650,592 | 3/1972 | Williams | 312/348.1 |
| 3,881,794 | 5/1975 | Henning | 312/259 |
| 3,957,320 | 5/1976 | Walter | 312/259 |
| 5,433,518 | 7/1995 | Skov | 312/348.1 |

FOREIGN PATENT DOCUMENTS

| | | | |
|---|---|---|---|
| 0281766 | 9/1988 | European Pat. Off. . | |
| 2224924 | 5/1990 | United Kingdom | 312/348.1 |

*Primary Examiner*—W. Donald Bray
*Assistant Examiner*—Gene L. Kim
*Attorney, Agent, or Firm*—Isaf, Vaughan & Kerr

[57] ABSTRACT

An improved method of constructing a cabinet drawer comprises joining the drawer end panels to the back of the drawer front panel and attaching a one piece unitary folded paperboard blank that defines both the bottom panel of the drawer and the back panel of the drawer. The bottom panel slides into a race defined by dado grooves in the drawer sides and front and the paperboard blank defining both the bottom panel and back panel is attached to the drawer by driving staples or other fasteners through the back panel into the back edges of the drawer sides.

20 Claims, 3 Drawing Sheets

CABINET DRAWER CONSTRUCTION AND METHOD

TECHNICAL FIELD

This invention relates generally to cabinets and cabinet making and more specifically to the fabrication of drawers for use in cabinets such as, for example, chests of drawers.

BACKGROUND OF THE INVENTION

For many years, drawers for use in cabinets such as chests of drawers have been fabricated from at least five wooden panels comprising a front panel, two side panels, a bottom panel, and a back panel. Traditionally, the wooden panels from which drawers are made have been cut from wood or processed wood such as plywood or pressboard. Because of the complexity of assembling and fastening the panels together, drawers have been constructed at least partially by a human fabricator, who attaches the side panels to the back of the front panel, secures the bottom panel in place to the bottom edges of the front and side panels, and secures the back panel in place spanning the back edges of the side panels. Obviously, a human fabricator is limited to the construction of one drawer at a time. Thus, the construction of drawers by hand has been a time consuming inefficient process that has been subject to human error and mistake. In addition, the construction of drawers from all wooden components can be relatively expensive because of the rising cost of wood.

In recent years, there have been attempts to reduce the cost of fabricating certain cabinets including the cost of fabricating their drawers. This has particularly been true in the area of inexpensive low-end furniture for use in house trailers, mobile homes, and the like. Numerous means of reducing the cost have been attempted. For example, many low-end cabinet drawers are formed from compressed wood products commonly known as particle board. In many instances, the particle board is provided with a skin that resembles wood grain in order to present a pleasing natural-looking appearance from a distance. While the use of particle board has reduced the cost of cabinet drawers somewhat, it nevertheless has not had a substantial impact for a number of reasons. First, the particle board is made from wood and can itself be relatively expensive. Further, the bottom and back panels of drawers are not susceptible to being made from particle board since they are too thin for particle board to be strong and effective. Finally, the mere adoption of particle board as a drawer construction material does not address the problem that a human fabricator still is usually required at some stage in the fabrication of the drawer.

Accordingly, there exists a continuing and heretofore unaddressed need for an improved method of constructing cabinet drawers that can substantially reduce the cost of such drawers and thus of the cabinets in which they are installed by providing a substantial reduction in cost of materials and by rendering the entire fabrication process of the drawers subject to automation and consequent elimination of human fabricators. Such a method should nevertheless result in a drawer that is aesthetically pleasing and that has sufficient strength and rigidity to withstand the normal wear and tear to which cabinet drawers are subjected. It is to the provision of such an improved method and of a drawer constructed according to such method that the present invention is primarily directed.

SUMMARY OF THE INVENTION

Briefly described, the present invention, in a preferred form thereof, comprises an improved method of constructing a cabinet drawer that addresses the problems and shortcomings of prior art drawer construction techniques. The method of this invention comprises joining a pair of drawer side panels to the rear face of a drawer front panel adjacent the opposed end edges of the front panel with the drawer side panels extending rearwardly from the drawer front panel. A substantially planer paperboard blank is provided with a fold line extending laterally across the blank intermediate the front and back edges thereof. The fold line divides the blank into a bottom panel portion and a back panel portion. The paperboard blank is then folded along the fold line so that the back panel portion of the blank forms an acute angle with respect to the bottom panel portion of the blank. In other words, the back panel portion of the blank is folded so that it forms an L-shape with respect to the bottom panel portion of the blank.

With the paperboard blank thus folded, it is secured to the joined together front and side panels of the drawer with the bottom panel portion of the blank spanning the bottom edges of the drawer front panel and side panels to form a drawer bottom and with the back panel portion of the blank spanning the back edges of the drawer sides to form a drawer back. In the preferred embodiment, the drawer front panel and side panels are provided with dado grooves extending around the bottom portions thereof. In this way, the bottom panel portion of the folded paperboard blank can be slid into the dado grooves until the back panel portion meets the back edges of the side panels. Fasteners, such as staples, can then be driven through the back panel portion of the blank into the rear ends of the side panels to secure the folded blank in place forming the completed drawer.

For additional strength and support, a second fold line is formed across the back panel portion of the blank to define a narrow long tab along the top of the back panel portion. This tab can then be folded over onto the back panel portion of the blank and secured thereto with adhesive to provide additional strength along the back of the drawer. If desired, the back panel portion of the blank can be slightly wider than the bottom panel portion so that the back panel portion extends completely over and covers the ends of the drawer sides for secure attachment with staples or nails.

With the just described method and construction, the fabrication of drawers can be entirely automated with a drawer fabricating machine. In this way, not only is money saved by making the bottom and back of the drawer from a single piece of paperboard, the expense and potential inaccuracies of a human fabricator can be eliminated. With an automated drawer fabricating machine performing the method of this invention to construct drawers, the production rate can be increased significantly over human fabricators and the quality of construction can be controlled to be consistently high.

Thus, it is an object of this invention to provide an improved method of constructing a cabinet drawer that reduces the use of wood forming the panels of the drawer and thus reduces the cost of the drawer.

Another object of this invention is to provide a method of constructing a cabinet drawer that is quick and simple to implement and that is subject to being performed entirely by automated drawer fabricating machines.

Another object of the present invention is to provide a cabinet drawer comparable in quality, appearance, and construction to prior art drawers at a lower cost.

A further object of this invention is to provide an improved method of constructing cabinet drawers that requires fewer cutting steps and thus is more efficient than prior art methods of constructing drawers from five wooden panels.

These and other objects, features, and advantages of the present invention will become more apparent upon review of the detailed description set forth below when taken in conjunction with the accompanying drawings, which are briefly described as follows.

DETAILED DESCRIPTION OF THE PREFERRED EMBODIMENT

Figure 1:
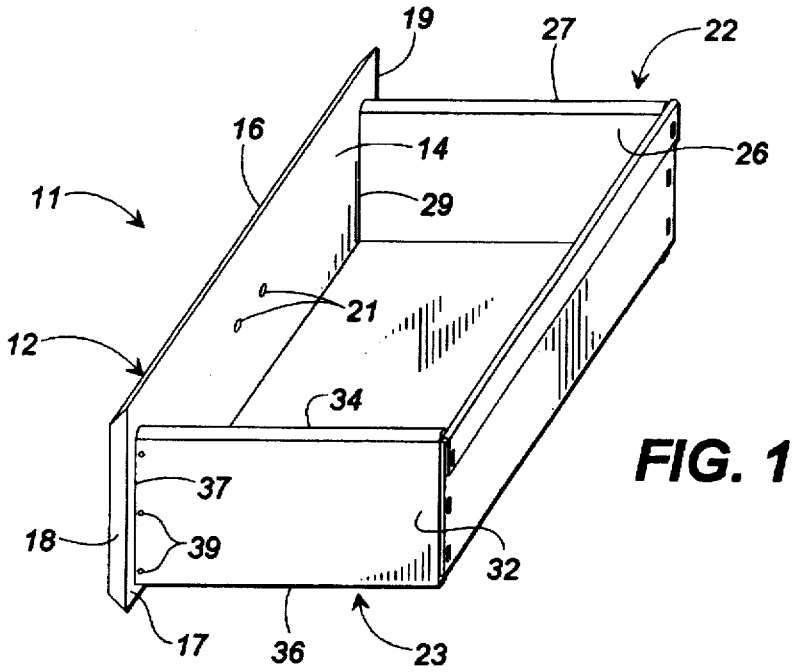
FIG. 1 is a perspective view of a completed cabinet drawer that embodies principles of the present invention in a preferred form.

Referring now in more detail to the drawings, in which like numerals refer to like parts throughout the several views, FIG. 1 illustrates in perspective format a completed cabinet drawer that embodies principles of the present invention in a preferred form. The cabinet drawer 11 is seen to be constructed from a front panel 12 having a front face (not visible in FIG. 1), a rear face 14, a top edge 16, a bottom edge 17, and opposed end edges 18 and 19. The front panel 12 is provided with a pair of holes 21 that accommodate handle hardware to be attached to the drawer.

Figure 2:
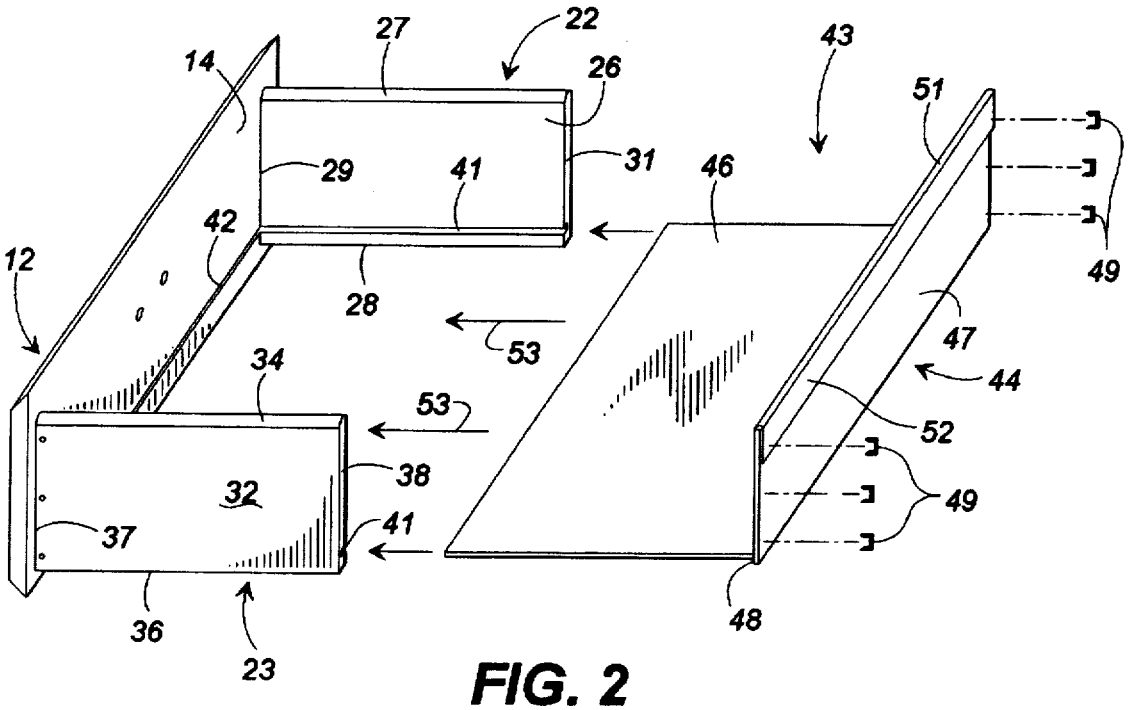
FIG. 2 is a perspective view illustrating how the method of the present invention is employed to fabricate an improved cabinet drawer.

A first side panel 22 has an outer face (not visible in FIG. 1), an inner face 26, a top edge 27, a bottom edge 28 (FIG. 2), a front edge 29, and a back edge 31 (FIG. 2). Similarly, a second side panel 23 has an outer face 32, an inner face (not visible in FIG. 1), a top edge 34, a bottom edge 36, a front edge 37, and a back edge 38.

The first and second side panels 22 and 23 are joined at their front edges 29 and 37 respectively to the rear face 14 of the drawer front panel 12 adjacent the opposed end edges 18 and 19 thereof. In the preferred embodiment, a pair of transversely extending dado grooves are formed in the rear face of the front panel 12 at the positions where the side panels 22 and 23 are to be attached. The front edges 29 and 37 of the side panels 22 and 23 are then inserted into the dado grooves and fixed with adhesive and pneumatically driven staples 39. In this way, the side panels 22 and 23 are joined to the rear face of the front panel with the drawer side panels extending rearwardly from the drawer front panel and with the bottom edges of the drawer side panels being generally co-planer with the bottom edge of the drawer front panel. In reality, the bottom edge 17 of the drawer front panel extends downwardly a bit further than the bottom edges of the side panels to provide a lip for engaging the facing of a cabinet in which the drawer is to be installed. Nevertheless, the bottom edges of the side panels and front panel are generally co-planer and this term should be understood to include the configuration of FIG. 1.

As best seen in FIG. 2, a longitudinally extending dado groove 41 is formed in the inner face of each of the side panels 22 and 23 and a corresponding longitudinally extending dado groove 42 is formed in the rear face 14 of the front panel 12. The dado grooves 41 and 42 extend closely adjacent the bottom edges of the side panels and the front panel and are positioned to align with each other when the panels are joined together to define a three-sided race for receiving the bottom panel, as discussed in more detail below.

A folded paperboard blank 43 is configured and adapted to form both the bottom of the completed drawer and the back thereof. The blank 43 preferably is fabricated from relatively dense paperboard that is sufficiently rigid to meet the demands of a cabinet drawer yet significantly less expensive than plywood, luan or other wood products typically used to form drawer bottoms. In addition, the paperboard blank 43 preferably is formed of a compressed paperboard core having an outer skin. This configuration provides both a pleasing appearance and strength to the blank. In the preferred embodiment, the paperboard skin is printed with a wood grain pattern to make it appear more aesthetically pleasing. However, any decorative pattern could be printed on the skin.

The paperboard blank 43 has a first fold line 44 that separates the blank into a bottom panel portion 46 and a back panel portion 47. In FIG. 2, the blank 43 has been folded along fold line 44 so that the back panel portion 47 extends at a substantially right angle relative to the bottom panel portion 46. In addition, the back panel portion 47 in the preferred embodiment is slightly wider than the bottom panel portion 46 such that, when the blank 43 is folded as shown in FIG. 2, a lip 48 is formed at both ends of the back panel portion 47. The purpose of the lip 48 is to permit the back panel portion 47 to extend beyond the depth of the dado grooves 41 entirely to the edge of the side panels 22 and 23. This, in turn, provides the widest area of overlap between the back panel portion 47 and the ends 31 and 41 of the side panels 22 and 23 so that staples 49, or other appropriate fasteners, can be driven through the back panel portion 47 and into the ends of the side panels to secure the back and bottom panels in place.

A second fold line 51 is formed in the paperboard blank 43 and defines at the top of the back panel portion 47 an elongated tab 52. The tab 52 is folded along the fold line 51 back onto the back panel portion 47 and is secured to the back panel portion 47 with adhesive. This configuration provides an added strength along the top of the back panel portion 47, which is desirable for providing a drawer of acceptable strength and rigidity. While the tab 52 in the preferred embodiment is shown extending only part way down the back panel portion 47, it will be understood by those of skill in the art that the tab 52 could be made to extend the entire height of the back panel if desired to provide even additional support. Indeed, the blank 43 could be sized so that the tab would extend all the way to the bottom of the back panel portion, and be folded back up to provide triple thickness paperboard on the back panel portion 47 for truly exceptional strength. Thus, the particular configuration shown in the preferred embodiment for the tab 52 should not be considered a limitation of the present invention.

In constructing a cabinet drawer according to the method of this invention, the paperboard blank 43 is folded as shown in FIG. 2 and the bottom panel portion 46 thereof is slid, as indicated by arrows 53, into the race formed by the dado grooves 41 and 42. When the bottom panel 46 is completely inserted into the race, the tabs 48 of the back panel 47 rest against the back edges 31 and 38 of the side panels 22 and 23. At this point, staples 49, or other appropriate fasteners, are driven through the back panel portion 47 into the ends of the side panels to secure both the bottom panel portion 46 and the back panel portion 47 in place on the drawer. With the back panel portion thus secured, the unitary nature of the blank 43 provides exceptional strength to the drawer structure.

Figure 3:
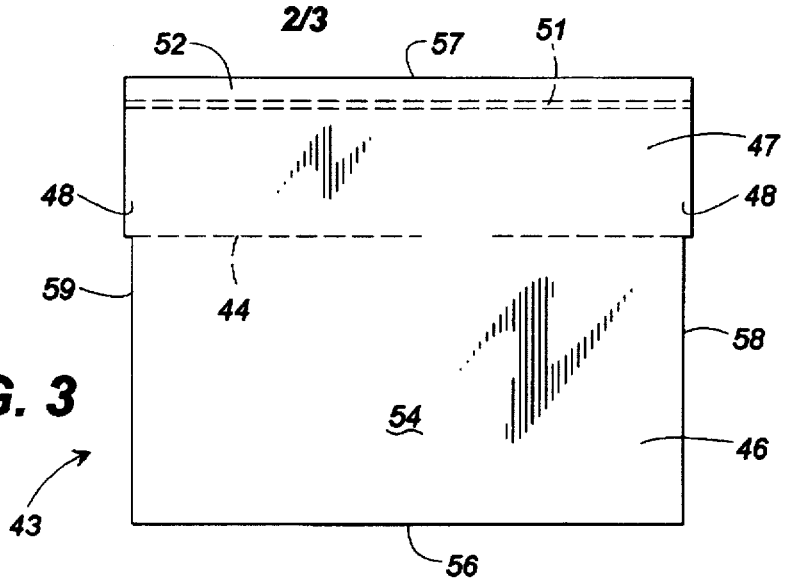
FIG. 3 is a top plan view of a paperboard blank for use in fabricating the bottom panel and back panel of a cabinet drawer according to the present invention.

FIGS. 3 and 4 illustrate the configuration and manipulation of the paperboard blank 43 to form the bottom and back panels of a drawer according to the present invention. The blank 43 is seen to be substantially planer having a top surface 54, a front edge 56, a back edge 57, and opposed side edges 58 and 59. A first fold line 44 is formed intermediate the front and back edges of the blank with the fold line extending between the side edges 58 and 59 of the blank. The fold line 44 divides the blank into a bottom panel portion 46 and a top panel portion 47. The top panel portion 47 is seen to be slightly wider than the bottom panel portion 46 to define lips 48 at the opposed ends of the back panel portion.

A second fold line 51 extends along and adjacent the back edge 57 of the blank to define an elongated tab portion 52 thereof. As detailed below, the fold line 44 is adapted to allow the back panel portion 47 to be folded up to an angle of 90 degrees relative to the bottom panel portion 46. The fold line 51 is adapted to allow the tab 52 to be folded through 180 degrees back onto the back panel portion 47.

Figure 4A:
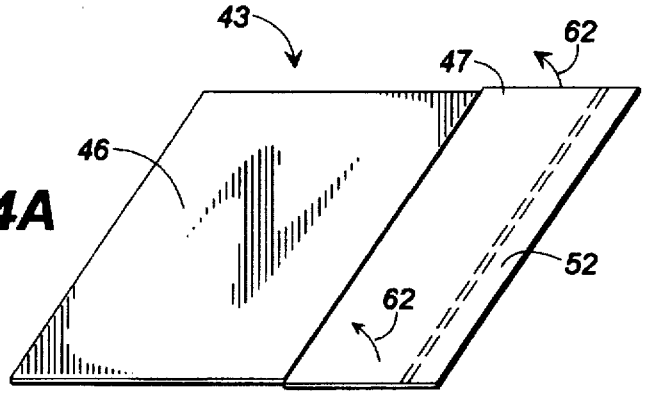
FIGS. 4A through 4C illustrate manipulation of the paperboard blank of FIG. 3 in performing the method of the present invention.
Figure 4B:
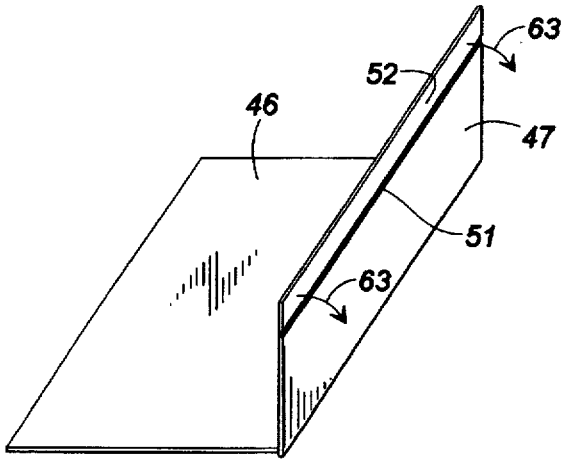
Figure 4C:
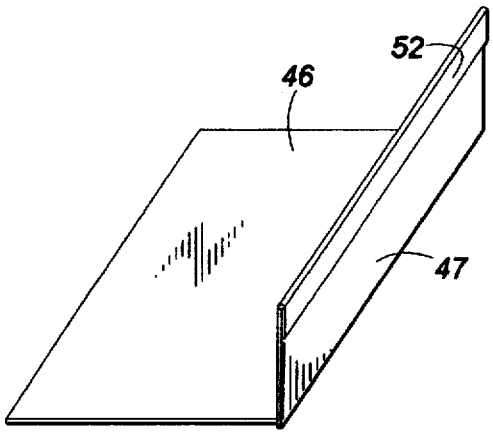

FIGS. 4A through 4C illustrate manipulation of the blank 43 according to the present invention. First, the back panel portion 47 of the blank 43 is folded upwardly as indicated by arrows 62 until the back panel portion 47 extends at a substantially right angle relative to the bottom panel portion 46 (FIG. 4B). Next, as illustrated in FIG. 4B, the tab 52 is folded along fold line 51 as indicated by arrow 63 until the tab is folded completely back onto the back panel portion 47 as illustrated in FIG. 4C. Preferably, an appropriate adhesive is applied between the tab 52 and the back panel portion 47 to secure the tab to the back panel portion 47. In this way, the upper edge of the back panel portion is provided with substantial additional strength through the reenforcing effect of the tab 52.

With the blank 43 completely folded as shown in FIG. 4C, its bottom panel portion is inserted into the race formed by dado grooves 41 and 42 (FIG. 2) and the back panel portion 47 is secured to the back ends of the side panels with staples or other appropriate fasteners, also as shown in FIG. 2. In this way, the entire installation of the bottom and back can be performed in one simple step that is highly susceptible to automation with machinery.

Figure 5A:
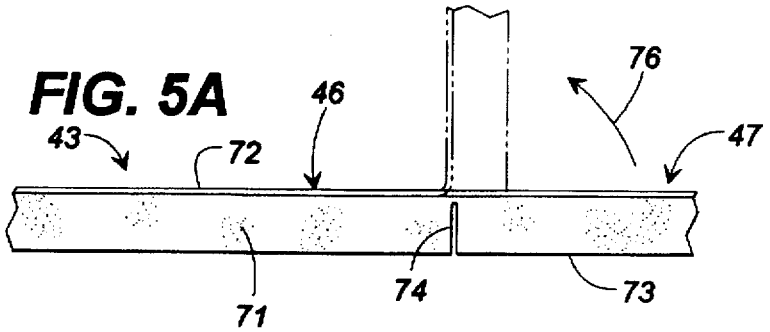
FIGS. 5A and 5B illustrate alternate methods of scoring the paperboard blank of FIG. 3 to provide for the folding step of this inventive method.
Figure 5B:
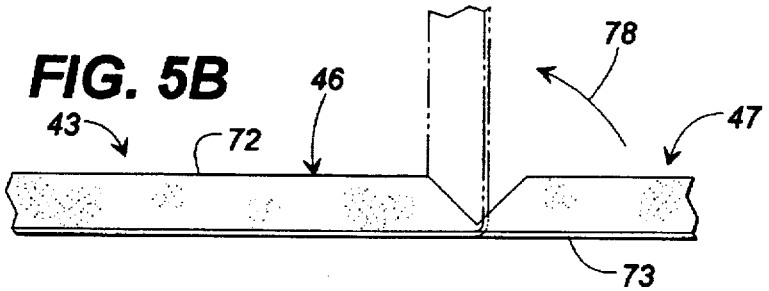

FIGS. 5A and 5B illustrate alternate methods of providing a fold line on the blank 43 to allow the back panel portion to be folded up relative to the bottom panel portion. In FIG. 5A, the paperboard blank 43 is seen to have a compressed paper core 71 covered with an outer skin 72. An outer skin 73 can also be provided on the bottom of the paperboard blank if desired.

To provide for folding of the blank, a slit 74 is formed in the back side of the panel 43 extending along the fold line. With this configuration, the back panel portion 47 can be folded up as indicated by arrow 76 to the position shown in phantom lines in FIG. 5A.

An alternate method of providing the fold line is shown in FIG. 5B. Here, a 90 degree V-groove is cut or scored in the top surface of the blank 43. The V-groove extends almost completely through the blank 43 but stops just short of the bottom skin 73 thereof. With this embodiment, the back panel portion 47 can again be folded up as indicated by arrows 78 to the position shown in phantom lines in FIG. 5B. With either embodiment 5A or 5B, the back panel portion 47 folds upwardly to a 90 degree angle relative to the bottom panel portion while the blank 43 remains in tact and unitary.

Figure 6A:
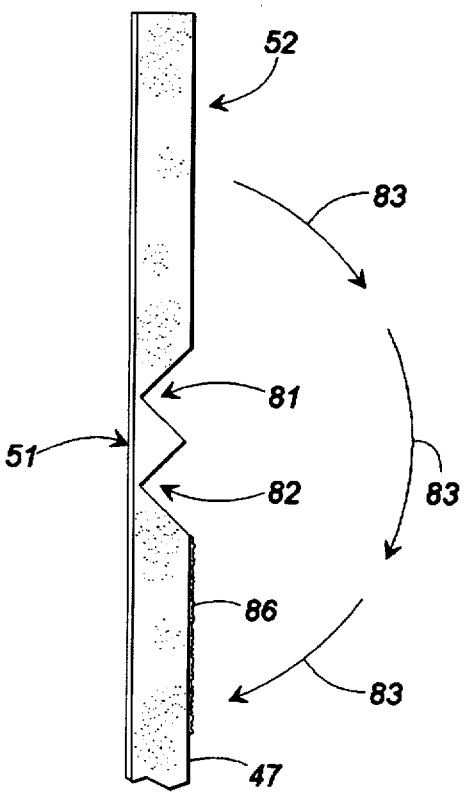
FIGS. 6A and 6B illustrate a preferred method of scoring the paperboard blank to form the reenforcing tab that is folded over onto the back panel portion of the blank to reenforce the back and provide added strength.
Figure 6B:
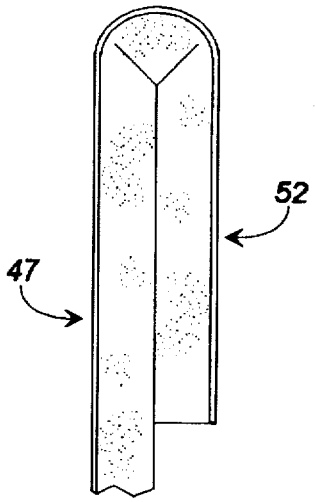

FIGS. 6A and 6B illustrate one preferred method of providing a fold line for folding the tab 52 over onto the back panel portion 47. In this embodiment, a pair of V-grooves 81 and 82 are cut along the fold line 51 on the back side of the blank 43. The V-grooves 81 and 82 permit the tab 52 to be folded over as indicated by arrows 83 until the tab 52 overlies the top of the back panel portion 47 as shown in FIG. 6B. Preferably, adhesive 86 is applied between the tab 52 and the back panel portion 47 so that, when folded as shown in FIG. 6B, the tab 52 is securely adhered to the back panel portion. This folded configuration provides both an aesthetically pleasing top edge for the back panel and enhances the strength of the back panel to support the contents of the drawer.

It will be clear to those of skill in the art that the methods shown in FIGS. 5 and 6 for providing fold lines in the blank 43 are not exhaustive. For example, the fold lines could be provided by simply embossing the paperboard blank along the fold line with embossing wheels. This would sufficiently weaken the material to allow it to be folded just as with the embodiments of FIGS. 5 and 6. Other means of providing a foldable crease in the blank 43 might also be provided within the scope of this invention.

The invention has been described herein in terms of preferred embodiments and methodologies. It will be clear to those of skill in the art, however, that various modifications might well be made to the illustrated embodiments within the scope of the invention. For example, while paperboard has been disclosed as the preferred material for forming the blank 43, it might also be formed from other materials including compressed wooden panels, composite paper wood panels, panels made from recycled materials, or otherwise. Any such substitute panel would perform with and come within the scope of the invention as long as it exhibited the foldability and other desirable qualities of paperboard. The preferred embodiment has also been illustrated with a small lip at the ends of the back panel portion 47 to overlap the back ends of the side panels. While this has been found to provide sufficient overlap for fastening the back panel, it is certainly not a requirement of the invention and should not be considered to be a limitation. Also, the invention has been presented in the preferred embodiment wherein the bottom panel portion slides into a race formed by dado grooves. Clearly, the bottom panel portion could just as well be attached to the bottom edges of the side panels with staples or the fasteners, such being equivalent to the use of dado grooves. The preferred embodiment is made of wood and paper by-products. However, this invention might easily be made of extruded plastic parts or other materials. Further, the order in which steps are performed in the illustrated embodiment is preferred. Nevertheless, the assembly and construction steps could be carried out in other orders such that the illustrated order is not a limitation of the invention. These and many other additions, deletions, and modifications, might well be made to the preferred embodiments illustrated herein without departing from the spirit and scope of the invention as set forth in the claims.

I claim:

1. A method of constructing a cabinet drawer comprising the steps of:

(a) providing a substantially rectangular drawer front panel having a front face, a rear face, a top edge, a bottom edge, and opposed end edges;

(b) providing a pair of substantially rectangular drawer side panels each having an outer face, an inner face a top edge, a bottom edge, a front edge, and a back edge;

(c) joining the pair of drawer side panels at their front edges to the rear face of the drawer front panel adjacent the opposed end edges thereof with the drawer side panels extending rearwardly from the drawer front panel and with the bottom edge of the drawer side panels being generally co-planer with the bottom edge of the drawer from panel;

(d) providing a separate substantially planer blank having a top surface, a bottom surface, a front edge, a back edge, and opposed side edges;

(e) forming a first fold line in the blank intermediate the front and back edges of the blank with the first fold line extending between the side edges of the blank, said fold line dividing the blank into a bottom panel portion and a back panel portion;

(f) folding the blank along the first fold line so that the back panel portion of the blank forms an angle with respect to the bottom panel of the blank;

(g) securing the folded blank to the joined front and side panels with the bottom panel portion of the blank spanning the bottom edges of the drawer front panel and the drawer side panels to form a drawer bottom and with the back panel portion of the blank spanning the back edges of the drawer side panels to form a drawer back;

(h) forming a second fold line in the blank intermediate the first fold line and the back edge of the blank with the second fold line extending between the side edges of the blank, said second fold line, the back edge of the blank, and the side edges of the blank to define a tab adjacent the back edge of the blank;

(i) folding the blank along the second fold line so that the tab is folded onto the back panel portion; and (j) adhering the tab to the back panel portion to provide additional strength and rigidity along the back panel portion of said blank.

2. A method of constructing a cabinet drawer as claimed in claim 1 and wherein step (d) further comprises forming the blank of paperboard.

3. A method of constructing a cabinet drawer as claimed in claim 2 and wherein step (d) further comprises forming the paperboard blank from a paper core and providing a skin on the top surface of the blank.

4. A method of constructing a cabinet drawer as claimed in claim 3 and wherein step (d) further comprises forming the paperboard blank with a skin covering the bottom surface of the blank.

5. A method of constructing a cabinet drawer as claimed in claim 1 and wherein step (d) further comprises forming the blank of wood.

6. A method of constructing a cabinet drawer as claimed in claim 1 and wherein step (d) further comprises forming the blank of beaver board.

7. A method of constructing a cabinet drawer as claimed in claim 1 and wherein step (e) comprises embossing the blank along the fold line to form a line of weakness along which the blank can be folded.

8. A method of constructing a cabinet drawer as claimed in claim 1 and wherein step (e) comprises scoring the blank along the fold line on the bottom surface of the blank to form a line of weakness along which the blank can be folded.

9. A method of constructing a cabinet drawer as claimed in claim 1 and wherein step (e) comprises cutting a V-groove in the top surface of the blank extending along the fold line to accommodate folding of the blank along the fold line.

10. A method of constructing a cabinet drawer comprising the steps of:

(a) providing a substantially rectangular drawer front panel having a front face, a rear face, a top edge, a bottom edge, and opposed end edges;

(b) providing a pair of substantially rectangular drawer side panels each having an outer face, an inner face, a top edge, a bottom edge, a front edge, and a back edge;

(c) joining the pair of drawer side panels at their front edges to the rear face of the drawer front panel adjacent the opposed end edges thereof with the drawer side panels extending rearwardly from the drawer front panel and with the bottom edge of the drawer side panels being generally co-planer with the bottom edge of the drawer front panel;

(d) providing a substantially planer blank having a top surface, a bottom surface, a front edge, a back edge, and opposed side edges;

(e) forming a fold line in the blank intermediate the front and back edges of the blank with the fold line extending between the side edges of the blank, said fold line dividing the blank into a bottom panel portion and a back panel portion;

(f) folding the blank along the fold line so that the back panel portion of the blank forms an angle with respect to the bottom panel of the blank;

(g) securing the folded blank to the joined front and side panels with the bottom panel portion of the blank spanning the bottom edges of the drawer front panel and the drawer side panels to form a drawer bottom and with the back panel portion of the blank spanning the back edges of the drawer side panels to form a drawer back; and where in step (a), the rear face of the drawer from panel is formed with a dado groove extending between the end edges of the drawer front panel adjacent the bottom edge thereof, in step (b), each of the inner face of the drawer side panels has a dado groove extending between the front and back edges of the drawer side panel adjacent the bottom edge thereof, in step (c) the drawer front and side panels are joined so that their respective dado grooves form a co-extensive race, and wherein step (g) comprises sliding the bottom panel portion of the blank into the race formed by the dado grooves.

11. A method of constructing a cabinet drawer as claimed in claim 10 and wherein step (g) further comprises fixing the back panel portion of the blank to the back edges of the drawer side panels after the bottom panel portion of the blank has been slid into the race to secure the blank in place defining the bottom and back of the drawer.

12. A method of constructing a cabinet drawer as claimed in claim 11 and wherein the back panel portion of the blank is wider than the front panel portion thereof to provide sufficient overlap of the side panel end portions for securely fixing the back panel portion to the back edges of the side panels.

13. A method of constructing a cabinet drawer as claimed in claim 11 and wherein the step of fixing the back panel portion of the blank to the back edges of the drawer side panels comprising driving fasteners through the back panel portion into the back edges of the side panels.

14. A method of constructing a cabinet drawer as claimed in claim 10 and further comprising the steps of forming an additional fold line in the blank extending along and adjacent the back edge thereof to define an elongated tab portion of the blank along its back edge and folding the blank onto itself along the additional fold line so that the tab portion becomes juxtaposed the back panel portion of the blank to provide additional strength and rigidity to the blank along the back edge thereof.

15. A method of constructing a cabinet drawer as claimed in claim 14 and further comprising the step of fixing the tab portion of the blank to the back panel portion to enhance strength.

16. A method of constructing a cabinet drawer as claimed in claim 15 and wherein the step of fixing the tab portion of the blank to the back panel portion comprises applying adhesive between the portions prior to the folding of the tab portion onto the back panel portion.

17. A cabinet drawer comprising:

a from panel having a front face, a rear face, a top edge, a bottom edge, and opposed end edges;

a spaced pair of side panels connected to and extending rearwardly from said front panel, each of said pair of side panels having an inner face, a top edge, a bottom edge, a front edge, and a back edge; the front edge of said side panels being attached to the rear face of said front panel adjacent the end edges thereof;

a separate blank forming a bottom panel portion and a back panel portion; and means for supporting said blank adjacent the bottom edges of said front panel and said side panels with the back panel portion of said blank attached to the back edges of said side panels;

wherein the bottom panel portion of said blank spans the bottom edges of said front panel and said side panels and wherein the back panel portion of said blank spans the back edges of said side panels.

18. The cabinet drawer as claimed in claim 17 wherein said blank is made from paperboard.

19. The cabinet drawer as claimed in claim 17 wherein the back panel portion of said blank is folded over onto itself to form an elongated tab, said elongated tab being adhered to the back panel portion to enhance the strength and rigidity of the back panel portion.

20. The cabinet drawer as claimed in claim 17 wherein said means for supporting said blank adjacent the bottom edges of said front panel and said side panels comprises a dado groove formed in the rear face of the said front panel and extending between the end edges thereof, and a dado groove formed in the inner face of each of said pair of side panels and extending between the front edges and back edges thereof, said dado grooves being sized and shaped to form a co-extensive race wherein the bottom panel portion of said blank is slidably received.

* * * * *